US009815599B2

(12) United States Patent
Spiegelhoff et al.

(10) Patent No.: US 9,815,599 B2
(45) Date of Patent: Nov. 14, 2017

(54) DISPENSING CLOSURE

(71) Applicant: AptarGroup, Inc., Crystal Lake, IL (US)

(72) Inventors: Tim Spiegelhoff, Burlington, WI (US); Frederic Duquet, Paris (FR); Kenneth Phillips, Mukwonago, WI (US); Curt Prusko, Wauwatosa, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 15/117,515

(22) PCT Filed: Apr. 8, 2016

(86) PCT No.: PCT/US2016/026687
§ 371 (c)(1),
(2) Date: Aug. 9, 2016

(87) PCT Pub. No.: WO2016/186748
PCT Pub. Date: Nov. 24, 2016

(65) Prior Publication Data

US 2017/0129659 A1 May 11, 2017

Related U.S. Application Data

(60) Provisional application No. 62/163,058, filed on May 18, 2015.

(51) Int. Cl.
*B65D 47/12* (2006.01)
*B65D 47/08* (2006.01)
(Continued)

(52) U.S. Cl.
CPC ..... *B65D 47/128* (2013.01); *A45D 34/00* (2013.01); *B65D 35/46* (2013.01); *B65D 47/08* (2013.01); *B65D 47/2031* (2013.01)

(58) Field of Classification Search
CPC ..... B65D 47/128; B65D 47/08; B65D 35/46; B65D 47/2031; B65D 47/18; A45D 34/00
(Continued)

(56) References Cited

U.S. PATENT DOCUMENTS 5,213,236 A 5/1993 Brown et al.
5,934,514 A 8/1999 Lampe et al.
(Continued)

OTHER PUBLICATIONS

International Search Report and Written Opinion for PCT Application No. PCT/US2016/026687.

*Primary Examiner* — Nicholas J Weiss
*Assistant Examiner* — Robert Nichols, II
(74) *Attorney, Agent, or Firm* — Wood, Phillips, Katz, Clark & Mortimer

(57) ABSTRACT

A dispensing closure (40) for a container (44) of a fluent substance is disclosed. The closure includes a body (54) having an inlet portion (68) defining an inlet flow passage (74) for receiving the fluent substance from the container (44) and an elongate outlet portion (70) defining an outlet flow passage (78) for discharging the fluent substance. The closure (40) further has a valve (56) located within the body (54), across the inlet flow passage (74) and spaced axially inwardly of outlet flow passage (78) to define a chamber (216). The valve (56) has a flexible, resilient valve head portion (160) that has confronting, openable portions (212) movable from a closed configuration to an open configuration when the valve head portion (160) is subjected to a pressure differential acting across the valve head portion (160).

1 Claim, 8 Drawing Sheets

(51) Int. Cl.
*B65D 47/20* (2006.01)
*B65D 35/46* (2006.01)
*A45D 34/00* (2006.01)

(58) Field of Classification Search
USPC ..... 222/494, 491, 490
See application file for complete search history.

(56) References Cited

U.S. PATENT DOCUMENTS

| | | | | |
|---|---|---|---|---|
| 5,944,234 | A * | 8/1999 | Lampe | B65D 47/0804 222/490 |
| 8,490,839 | B2 * | 7/2013 | Mihashi | A61F 9/0008 222/189.06 |
| 9,259,110 | B2 * | 2/2016 | Garneau | B65D 47/2031 |
| 2007/0251079 | A1 | 11/2007 | Pugne | |
| 2009/0314792 | A1 | 12/2009 | Lenz et al. | |
| 2011/0144598 | A1 * | 6/2011 | Mihashi | A61F 9/0008 604/295 |
| 2012/0067922 | A1 * | 3/2012 | Benoit-Gonin | B65D 47/0857 222/153.06 |
| 2013/0026191 | A1 | 1/2013 | Duquet et al. | |
| 2013/0075431 | A1 * | 3/2013 | Wochele | A61F 9/0008 222/420 |

* cited by examiner

DISPENSING CLOSURE

TECHNICAL FIELD

The present invention relates generally to a dispensing closure for a container of a fluent substance.

BACKGROUND OF THE INVENTION AND TECHNICAL PROBLEMS POSED BY THE PRIOR ART

Closures are employed to selectively prevent or permit communication between the exterior and interior of a container (e.g., bottle, pouch, etc.). The closure has a body that defines at least one passage through the body for communicating with an opening of the container, and the closure body can be either (1) a separate structure for being attached to the container at the opening, or (2) a structure formed as a unitary portion of the container at the opening. A closure specifically designed for facilitating the dispensing of a fluent product is known as a dispensing closure. A typical dispensing closure has a body with a valve and/or a lid (e.g., cap or cover) to selectively close off the body passage.

Various fluent materials or substances (including oils, lotions, creams, gels, liquids, food items, granules, powders, etc.) may be packaged in a rigid, flexible, or collapsible container having a closure that can be opened and closed. A flexible container may be pressurized by a user to force the fluent substance from the container and through the closure body to dispense the fluent substance at a target region (e.g., onto a target surface area). If the container is a bottle, pouch, or other such container, then such a container with the closure mounted thereon and the contents stored therein may be characterized as a "package."

A dispensing closure for a container may be provided with an elongate or pipette closure body for applications of various fluent substances. The elongate closure body may be especially suited for application of a fluent substance on a target area that is difficult to access, such as the application of hair oils to the human scalp. For low viscosity fluent substances, it may be difficult to cleanly and accurately dispense such a substance from an elongate closure body—especially in applications where the user squeezes the container to pressurize the fluent substance and expel the fluent substance. Residual fluent substance may remain in the passage through the closure body and may leak out of the passage even after the user has ceased pressurizing the container.

The inventors of the present invention have discovered that, in some applications, it may be difficult to properly dispense a fluent substance, especially a relatively low viscosity fluent substance, through a closure on a container in a desired manner. In particular, the inventors of the present invention have determined that it would be desirable to provide an improved dispensing closure for accommodating the dispensing of a fluent substance, especially a relatively low viscosity fluent substance, in a controlled and clean manner.

The inventors of the present invention have also determined that, in some applications, it would be advantageous for the user to be able to dispense the fluent substance in individual drops of a desired volume and/or in a steady stream.

The inventors of the present invention have further determined that it would be beneficial to provide an improved dispensing closure that would facilitate the termination or "cut off" of the flow in a clean and relatively precise manner, and in a way that would minimize leakage and/or dripping.

The inventors of the present invention have also determined that, in many applications, it may be desirable to provide an improved closure as part of a package wherein the closure structure facilitates or accommodates the cleaning of the closure and/or minimizes the potential for accumulation of residue, dirt, grime, etc. during the useful life of the package.

The inventors of the present invention have also determined that it would be desirable to provide an improved closure that can be configured for use with a container of a fluent substance so as to have one or more of the following advantages: (1) ease of manufacture and/or assembly, and (ii) relatively low cost of manufacture and/or assembly.

The inventors of the present invention have invented a novel structure for a closure for use with a container wherein the closure includes various advantageous features not heretofore taught or contemplated by the prior art.

BRIEF SUMMARY OF THE INVENTION

According to broad aspects of one form of the present invention, a dispensing closure is provided for a container having an opening between an exterior of the container and an interior of the container where a fluent substance may be stored. The dispensing closure has a closure body that has an inlet portion that can be located at the container opening and that defines an inlet flow passage for communicating with the container interior. The closure body further has an elongate outlet portion defining an outlet flow passage to accommodate the flow of a substance from said inlet flow passage through the dispensing closure.

The dispensing closure further has a valve with a flexible, resilient valve head portion. The valve head portion has at least one self-sealing slit through the valve head portion, and confronting, openable portions along the at least one self-sealing slit in an initially closed configuration. The openable portions are movable from the closed configuration to an open configuration when the valve head portion is subjected to a pressure differential acting across the valve head portion.

The valve is located across the inlet flow passage and is spaced axially inwardly from the outlet flow passage such that the valve and the closure body together define a chamber axially inwardly of, and communicating with, the outlet flow passage to accommodate the valve head portion openable portions in the open configuration.

It should be appreciated that the invention may include any or all of the above-described features, include only one of the above features, more than one of the above features, and any combination of the above features. Furthermore, other objects, features and advantages of the invention will become apparent from a review of the entire specification including any appended claims and drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this specification and the accompanying drawings disclose only a specific form as an example of the invention. The invention is not intended to be limited to the embodiment so described, and the scope of the invention will be pointed out in the appended claims.

For ease of description, many figures illustrating the invention show an embodiment in the typical orientation that the closure would have at the opening of a container in the form of an upright bottle, and terms such as "inward", "outward", "axial", "radial", "lateral", etc., are used with reference to this orientation. The terms "axial" and "radial" are used with respect to an axis "A" (FIGS. 6 and 6A), generally defined by a central passage through the closure and defining a direction of flow of the fluent substance from the container interior to the container exterior. The phrase "axially inwardly" refers to the direction toward the container interior. The phrase "axially outwardly" refers to the direction away from the container interior. It will be understood, however, that the closure of this invention may be manufactured, stored, transported, used, and sold in an orientation other than the orientation described.

The dispensing closure, or simply closure, of this invention is suitable for use with a variety of conventional or special containers, the details of which, although not fully illustrated or described, would be apparent to those having skill in the art and an understanding of such containers. The particular container, per se, that is illustrated and described herein forms no part of, and therefore is not intended to limit, the present invention. It will also be understood by those of ordinary skill that novel and non-obvious inventive aspects are embodied in the described exemplary closure alone.

The closure is especially suitable for use on a container that contains a fluent material or substance in the form of an oil or lotion that can be dispensed, or otherwise discharged, from the container through the opened closure. Such fluent substances may be, for example, a food product, a personal care product, an industrial product, a household product, or other types of products. Such substances may be for internal or external use by humans or animals, or for other uses (e.g., activities involving medicine, manufacturing, commercial or household maintenance, construction, agriculture, etc.).

An embodiment of a closure of the present invention, and components thereof, is illustrated in FIGS. 1-14 wherein the closure is designated generally by reference number 40. In the illustrated embodiment, the closure 40 is provided in the form of a separate closure which is configured to be attached to a container that would typically contain contents such as a product or products consisting of articles or fluent substance.

Figure 1:
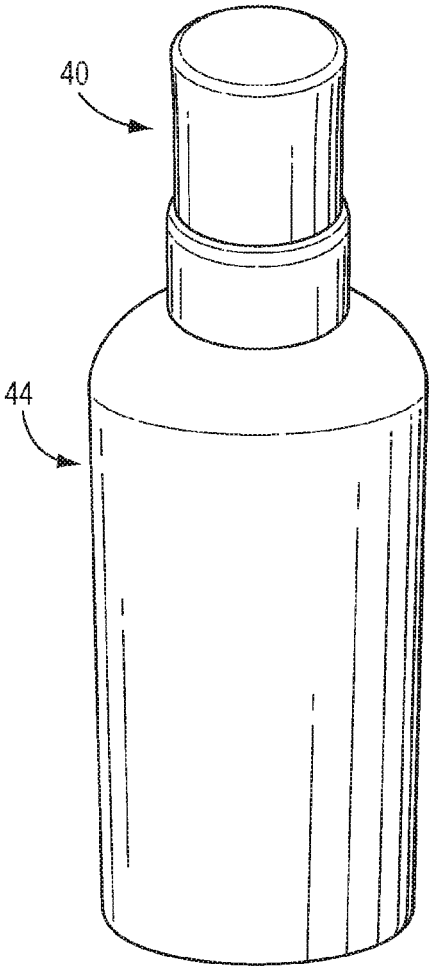
FIG. 1 is a perspective view, taken from above, of a dispensing closure of the present shown assembled with a lid and installed on a container in the form of a bottle—the closure, lid, and bottle together defining a "package"

The container may be any conventional type, such as a collapsible, flexible pouch, or may be a generally rigid container (which may have somewhat flexible, resilient walls), such as a bottle or tank. FIG. 1 shows an embodiment of the closure 40 attached to a container 44 that is a generally rigid bottle. The container may be part of a larger dispensing system (not illustrated) which may include, or be part of, for example, a medical device, processing machine, dispenser, reservoir on a machine, etc., wherein the system has an opening to the system interior.

The container, or a portion thereof, may be made from a material suitable for the intended application (e.g., a thin, flexible material for a pouch wherein such a material could be a polyethylene terephthalate (PET) film or a polyethylene film and/or an aluminum foil, or a thicker, less flexible material such as molded polyethylene or polypropylene for a more rigid container 44 such as a bottle.

In applications wherein the closure 40 is mounted to a container 44 such as a bottle or pouch (not illustrated), it is contemplated that typically, after the closure manufacturer makes the closure (e.g., by molding parts of the closure 40 from a thermoplastic polymer and assembling them), the closure manufacturer will then ship the closure 40 to a container filler facility at another location where the container 44 is either manufactured or otherwise provided, and where the container is filled with a product. If the container is a collapsible pouch, then the closure may include a suitable fitment portion that can be attached to the pouch as the pouch is being made and filled, or as the pouch is being made but before the pouch is subsequently filled through the open closure or through open regions of the pouch walls that are later sealed closed.

In the illustrated embodiment of the closure 40, the closure 40 is provided as a separately manufactured article, component, or unit for being non-removably assembled or mounted on a container 44 such as the bottle. It will be appreciated, however, that in some applications, it may be desirable for the closure 40 to be attached to a container in a manner that would allow a user to remove the closure 40. Further, it may be desirable for the closure (or at least the body of the closure) to be formed as a unitary part, or extension, of the container (e.g., a bottle) wherein such a unitary part or extension also (i.e., simultaneously) defines an end structure of the container, per se.

The illustrated embodiment of the closure 40, if initially formed separately from the container 44, is adapted to be attached to the container 44 at an opening which provides access to the container interior and to the fluent contents contained therein after a portion of the closure 40 is opened as described hereinafter.

The container 44, per se, such as a bottle, pouch, or other container, per se, does not form a part of the broadest aspects of the present invention. The container, or other system, may have any suitable configuration.

Figure 2:
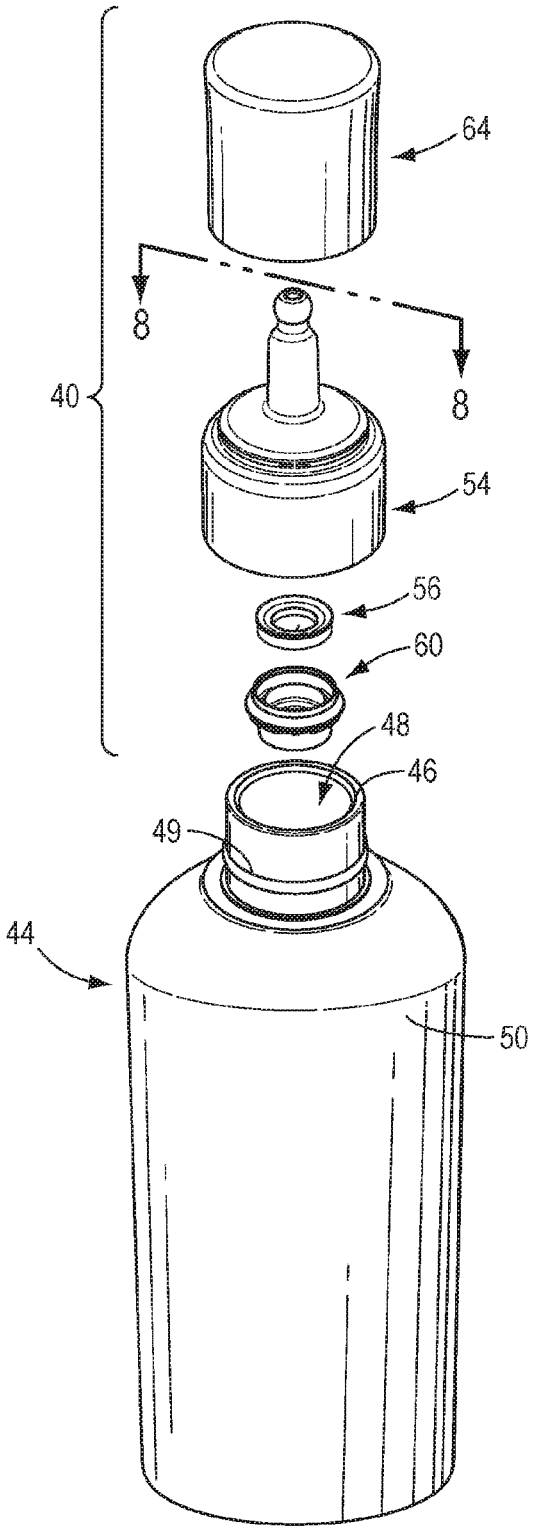
FIG. 2 is an exploded, perspective view of the package illustrated in FIG. 1.
Figure 3:
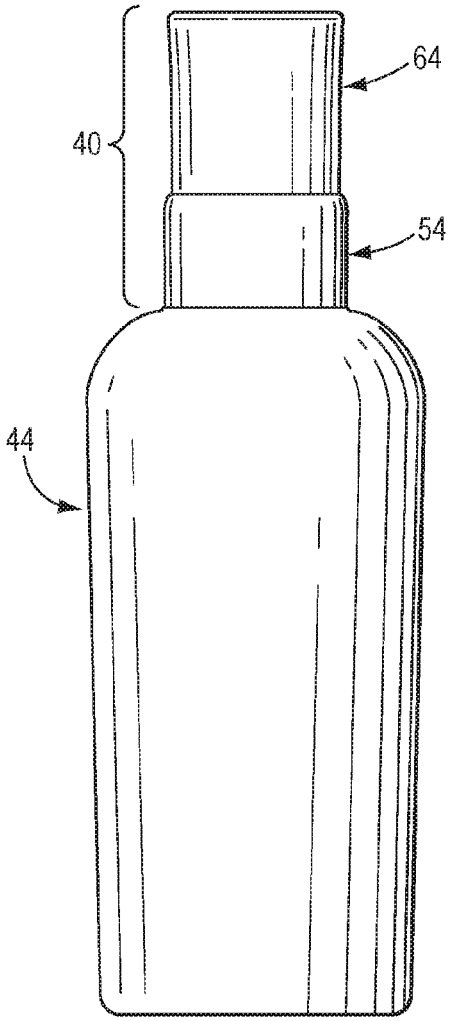
FIG. 3 a front elevation view of the package illustrated in FIG. 1.
Figure 4:
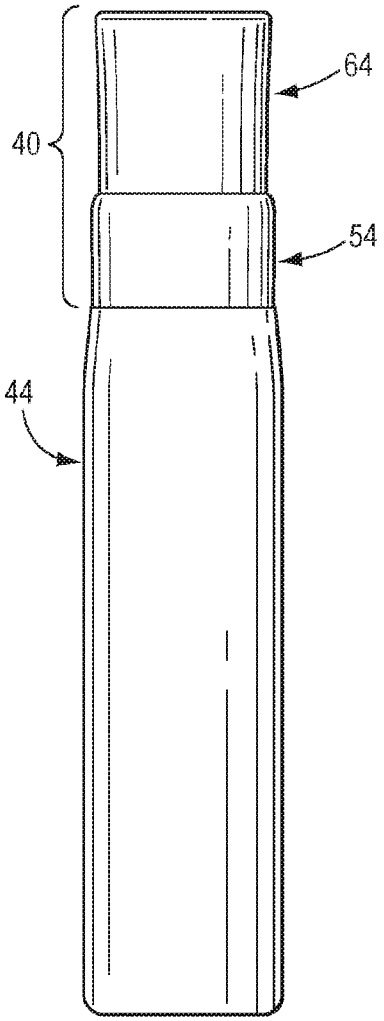
FIG. 4 is a side elevation view of the package illustrated in FIG. 1.
Figure 5:
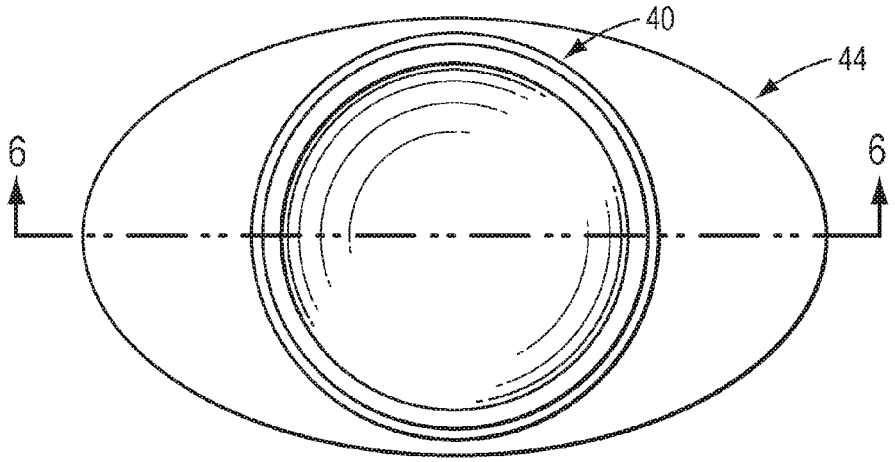
FIG. 5 is a top plan view of the package illustrated in FIG. 1.

With reference to FIG. 2, where the container 44 is a bottle, the bottle typically includes an upper end portion 46 or other suitable structure on some part of the bottle that defines the bottle mouth or opening 48 and a snap-fit bead 49, and such a bottle upper end portion 46 typically has a cross-sectional configuration with which the closure 40 is adapted to engage. The main body portion 50 of the bottle may have another cross-sectional configuration that differs from the cross-sectional configuration of the bottle upper end portion 46 at the bottle opening 48. On the other hand, the bottle may instead have a substantially uniform shape along its entire length or height without any portion of reduced size or different cross-section (not illustrated). The bottle may have a generally rigid, or somewhat flexible, wall or walls which can be grasped by the user.

The particular embodiment of the closure 40 illustrated in the FIG. 2 is especially suitable for use with a container 44 that is a bottle having a substantially flexible wall or walls that can be squeezed or deflected laterally inwardly by the user to increase the internal pressure within the bottle so as to force the product out of the bottle and through the opened closure 40. In a battle with a flexible wall or walls, such a flexible wall or walls typically have sufficient, inherent resiliency so that when the squeezing forces are removed, the bottle walls return to the normal, unstressed shape.

In other applications it may be desirable to employ a generally rigid container, and to pressurize the container interior at selected times with a piston or other pressurizing system (not illustrated), or to reduce the exterior ambient pressure so as to suck the material out through the open closure.

In some other applications for use with a container which may be a product containment system or other type of system, the closure 40 can function to permit or prevent the egress or ingress of substances relative to the system in which the closure 40 is installed.

For example, in some applications it may be desirable to also accommodate filling or refilling of the container 44 with the fluent contents through the opened closure 40 into the container 44.

In the particular embodiment illustrated in FIGS. 1-14, the closure 40 includes a closure body 54, a valve 56, and a retainer ring or retainer 60. In the illustrated preferred embodiment, a cap or lid 64 is optionally provided for being removably mounted on the closure 40. The closure body 54, valve 56, retainer ring 60, and lid 64 are preferably formed or molded as separate structures. The closure body 54, retainer ring 60, and lid 64 are each preferably molded from a suitable thermoplastic material such as polyethylene or polypropylene. Other materials may be employed instead. It will be understood that in alternative designs (not illustrated), two or more of the components (e.g., the closure body and a hinged lid) may be unitarily formed or molded together as one connected structure. Further, it will be understood that the closure body 54 may be unitarily formed or molded as an extension of the container 44.

Figure 8:
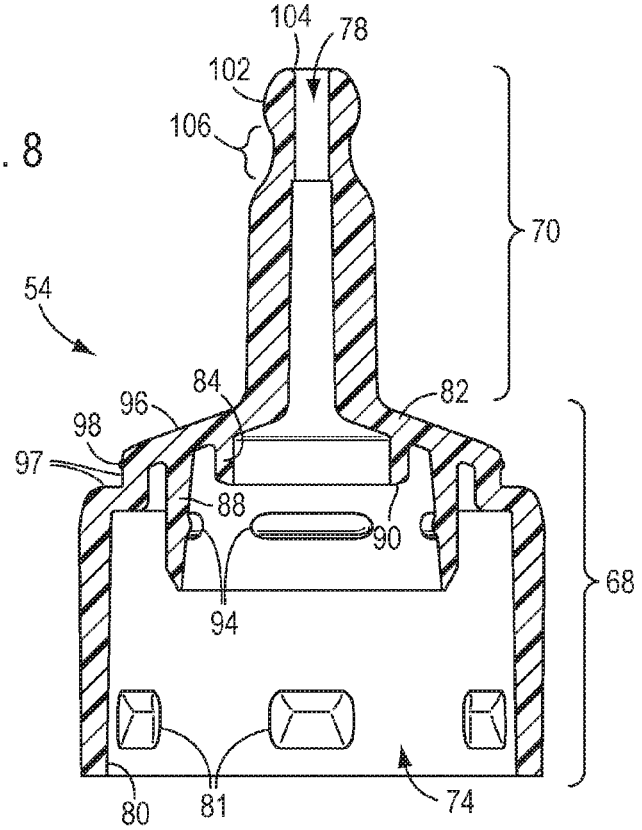
FIG. 8 is a cross-sectional view of the closure body taken generally along the plane 8-8 in FIG. 2.

Referring now to FIG. 8, the closure body 54 includes a base or inlet portion 68 from which a pipette or elongate outlet portion 70 projects axially outwardly. The inlet portion 68 defines an inlet flow passage 74 for being located at the opening 48 of the bottle 44 (FIG. 6) to communicate with an interior of the bottle 44 and to receive a fluent substance. The elongate outlet portion 70 defines an outlet flow passage 78 that communicates with the inlet flow passage 74 to permit a fluent substance to flow into, and out of, the closure body 54. The elongate outlet portion 70 is generally tapered, with a radial diameter less than that of the inlet portion 68. It will be appreciated, however, that the closure body 54 may take a variety of forms, and need not have an elongate outlet portion 70 that is narrower than the inlet portion 68. Further, it is understood that the inlet and outlet portions 68 and 70, respectively, and the inlet and outlet flow passages 74 and 78, respectively, need not have circular cross-sections as shown. For example, the inlet and outlet portions 68 and 70, respectively, and/or the inlet and outlet flow passages 74 and 78, respectively, may be elliptical, polygonal, or some irregular shape. The closure body 54, and particularly the elongate outlet portion 70, is preferably formed from a transparent or partially transparent material such that the fluent substance is visible to a user of the closure 40 when the fluent substance is present within the outlet flow passage 78, as discussed in detail hereinafter.

Figure 6:
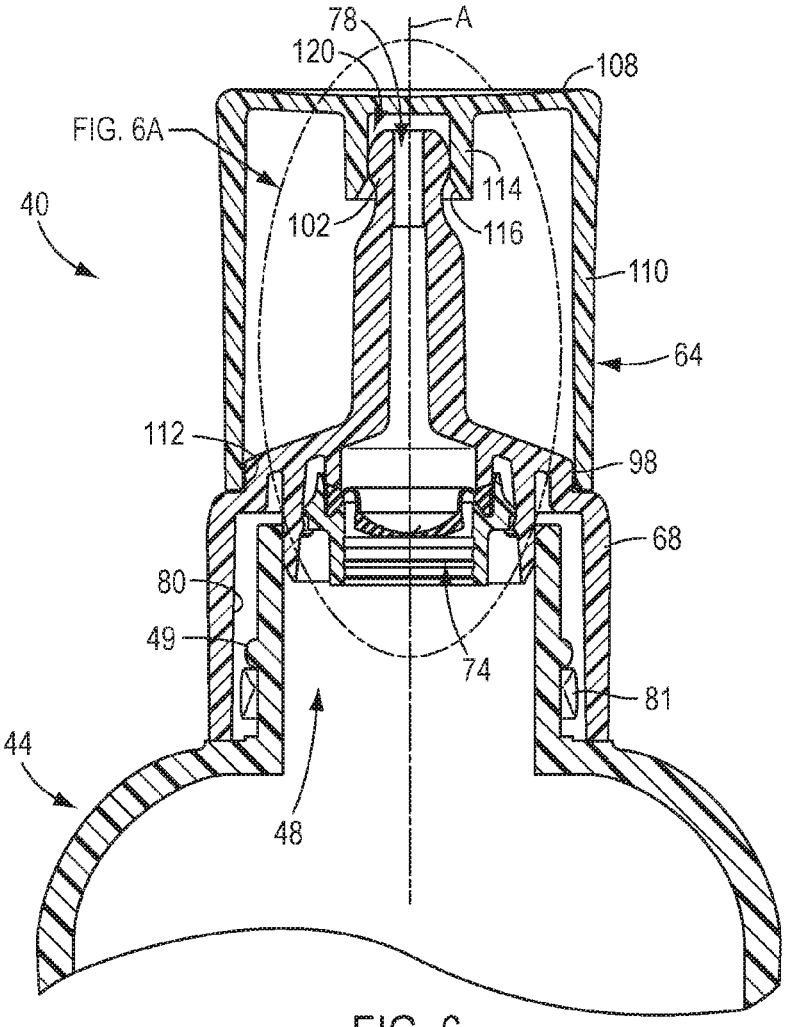
FIG. 6 is a fragmentary, cross-sectional view of the upper portion of the package taken generally along the plane 6-6 in FIG. 5.

Referring to FIGS. 6 and 8, the closure body 54 has an interior surface 80 with a plurality of snap-fit beads or projections 81 extending radially inwardly therefrom. The snap-fit beads 81 cooperate with the container snap-fit bead 49 to effect a snap-fit engagement securely attaching the closure body 54 to the container 44 at the opening 48 of the container 44. It will be appreciated that other conventional or special means of connecting the closure body 54 to the container could be employed, such as mating threads, bi-injection molding, adhesives, mechanical locks, spin welding of the closure to the container, etc. (not illustrated).

If the closure body 54 is to be used on a flexible pouch (not illustrated), then it is presently contemplated that the closure body inlet portion 68 would have a suitable fitment configuration (not illustrated) for being attached to the pouch, and most pouch manufacturers will prefer to install the closure body inlet portion 68 at an opening formed in the pouch with heat sealing techniques or ultrasonic sealing techniques.

Referring to FIG. 8, the closure body 54 has a top end or deck 82 and a first or inner wall 84 that is annular and that extends axially inwardly from the top deck 82. A second, or outer wall 88 is also annular, and surrounds the inner wall 84 and also extends axially inwardly from the top deck 82. The inner wall 84 terminates in a generally frusto-conical, sloping valve-seating surface 90, the function of which will be discussed in detail hereinafter. The outer wall 88 has a plurality of snap-fit beads or projections 94 extending radially inwardly therefrom for engaging a mating feature on the retainer ring 60 (FIG. 6A) to hold the valve 56 (FIG. 6A) in a location between the inlet and outlet flow passages 74 and 78, respectively, as will be discussed in detail hereinafter.

Now referring to FIGS. 7 and 8, the closure body top deck 82 (FIG. 8) has a generally frustoconical, sloping exterior surface 96 terminating in a shoulder 97 that has an annular snap-fit bead 98 which is adapted to engage a mating feature on the lid 64 (FIG. 6) to secure the lid 64 to the closure body 54, as will be discussed in detail hereinafter. The elongate outlet portion 70 extends axially outward from the top deck 82 and terminates in a distal tip or end 102. Preferably, the tip 102 defines a generally convex or partially spherical exterior surface. In the particular embodiment of the closure 40 illustrated, the tip 102 has the form of a truncated sphere, with the truncated portion being the axially outermost portion of the tip 102. The tip 102 has a lip or an axially and laterally inwardly curving surface 104 (FIG. 6A) connecting to the outer surface of the tip 102 to the outlet flow passage 78. The function of the surface 104 will be discussed in detail hereinafter. An exterior, annular recess 106 extends around the elongate outlet portion 70 proximal to, and axially inward of, the tip 102. The recess 106 accommodates a sealing feature of the lid 64 as discussed hereinafter.

Referring now to FIG. 6, the optional lid 64 has a slightly concave top end 108 and a depending, annular wall 110. The annular wall 110 has a snap-fit bead 112 extending radially inwardly therefrom to engage with the bead 98 (FIGS. 6 and 7) of the closure body 54 to removably secure the lid 64 to the closure body 54. The lid 64 may alternatively be connected to the closure body 54 by a connecting structure such as a hinge (not illustrated). The connecting structure or hinge could be of any suitable type. One form of a hinge that may be used is the over-center, snap-action type hinge. Other types of hinges could be used. Alternatively, the lid 64 could be releasably mounted to the closure body 54 with a press-fit or mating screw threads.

The lid top end 108 has an internal annular wall 114 extending axially inwardly therefrom for creating a fluid-tight seal against the tip 102 of the closure body 54. The annular wall 114 has a chamfer or sloping surface 116 for guiding the tip 102 into the interior of the annular wall 114. As can further be seen in FIG. 6, when the lid 64 is installed on the closure body 54, there remains a space or gap 120 between the lid top end 108 and the tip 102.

Figure 6A:
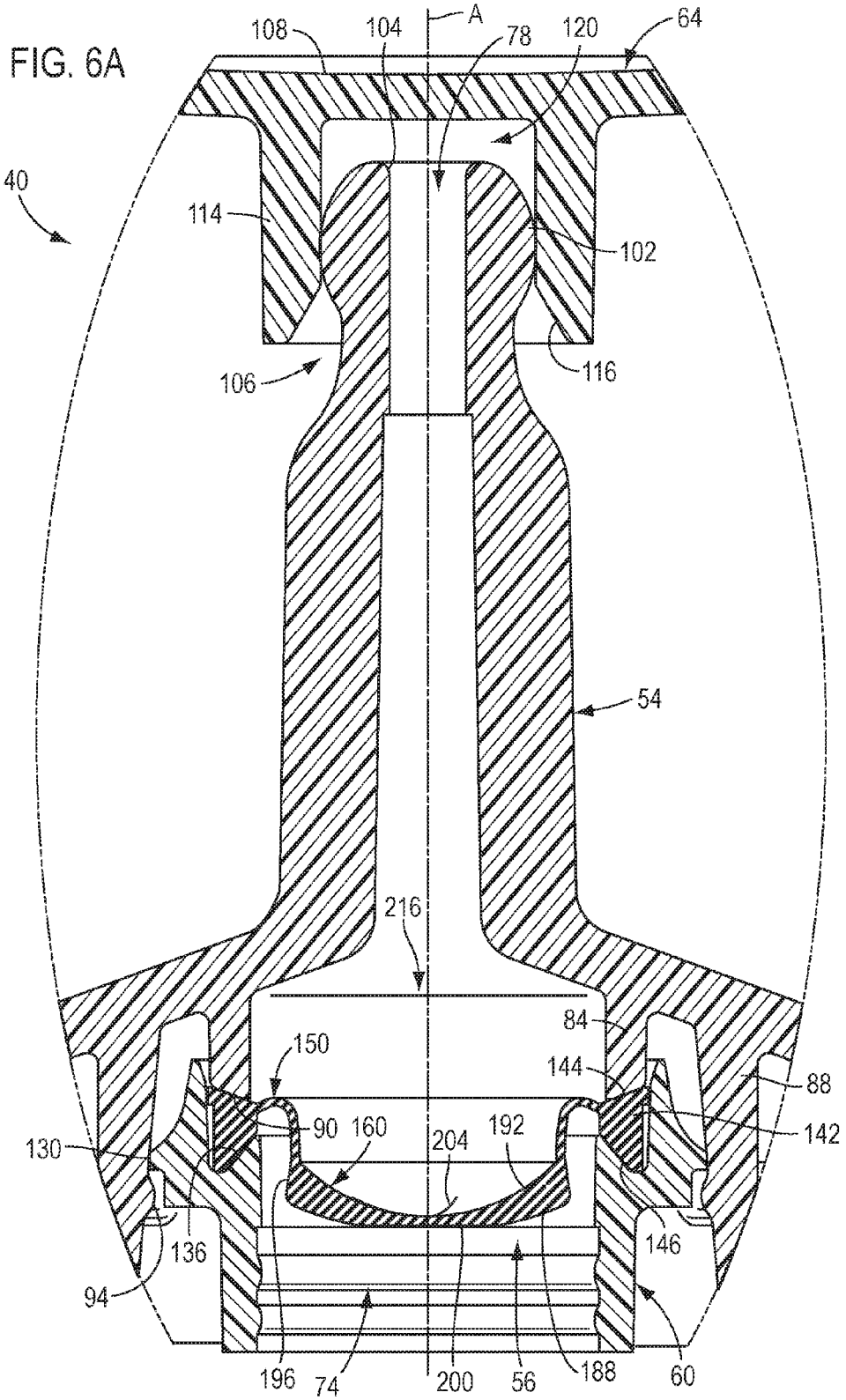
FIG. 6A is an enlarged, fragmentary, cross-sectional view of a portion of the structure shown enclosed in the circled area in FIG. 6, and in FIG. 6A an internal valve is shown in the normally closed configuration.
Figure 7:
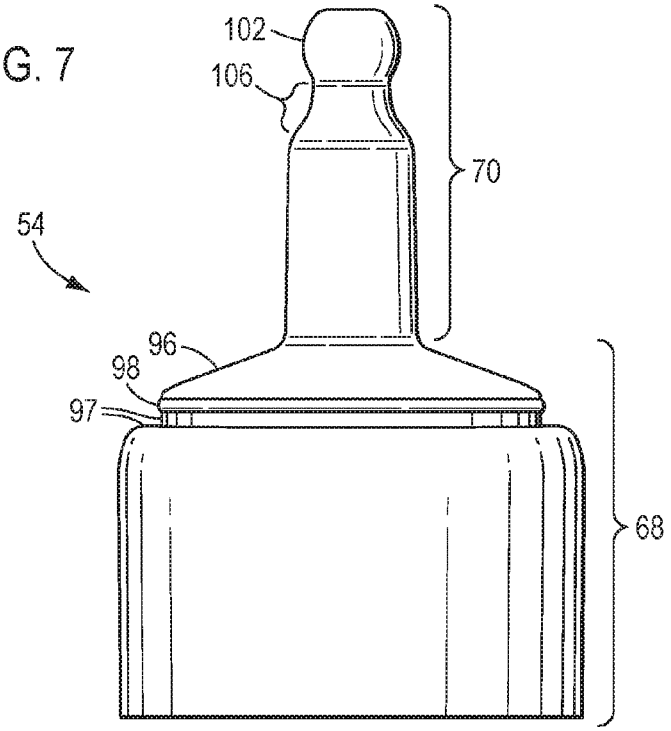
FIG. 7 is a side elevation view of the closure body shown in FIG. 2.
Figure 14:
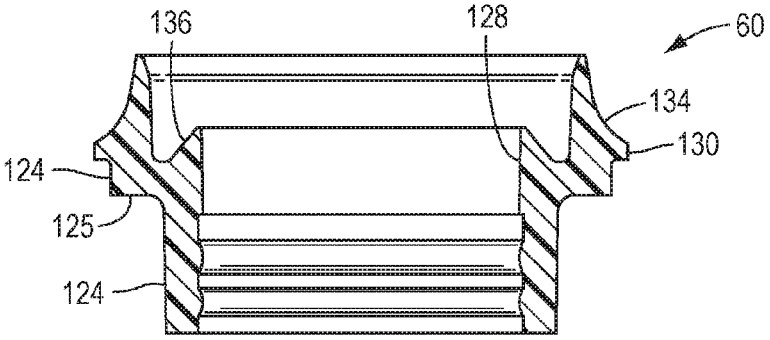
FIG. 14 is a cross-sectional view of the retainer ring taken generally along the plane 14-14 in FIG. 13.

With reference to FIGS. 6A and 14, the retainer or retainer ring 60 is provided for securing the valve 56 (FIG. 6A only) to the closure body 54 (FIG. 6A only). The retainer ring 60 has a pair of annular walls 124 (FIG. 14 only) connecting in the form of a shoulder 125 (FIG. 14 only), the walls 124 define an internal passage 128 (FIG. 14 only). An exterior, annular projection 130 extends radially outwardly from one of the annular walls 124 for engagement with the aforementioned snap-fit beads 94 (FIG. 6A only) of the closure body outer wall 88 (FIG. 6A only). The retainer ring 60 has an external, concave surface 134 for guiding the retainer ring 60 into the closure body outer wall 88 when the retainer ring 60 is assembled to the closure body 54. The retainer ring 60 further has a generally frusto-conical, valve-seating surface 136 for cooperating with the closure body valve-seating surface 90 (FIG. 6A only) to retain the valve 56 as discussed in detail hereinafter.

It will be appreciated that the retainer ring 60 need not be circular, and may have other polygonal or irregular shapes. Furthermore, the retainer ring 60 may have a plurality of discrete projections or screw threading for engaging a mating feature in the closure body (not illustrated). Alternatively, the retainer ring 60 need not be provided with an annular projection 130, and the ring 60 could instead be press fit, adhered, vibratory welded, or otherwise attached to the closure body 54.

In some embodiments (not illustrated), it may be desirable to clamp or retain the valve 56 between the closure body 54 and the upper end 46 of the container 44, and therefore no retainer ring 60 need be provided. Alternatively, the valve 56 may be adhesively secured, heat welded, or bi-injection molded to either of the closure body 54 or the container 44, and such that no retainer ring 60 need be provided.

Figure 9:
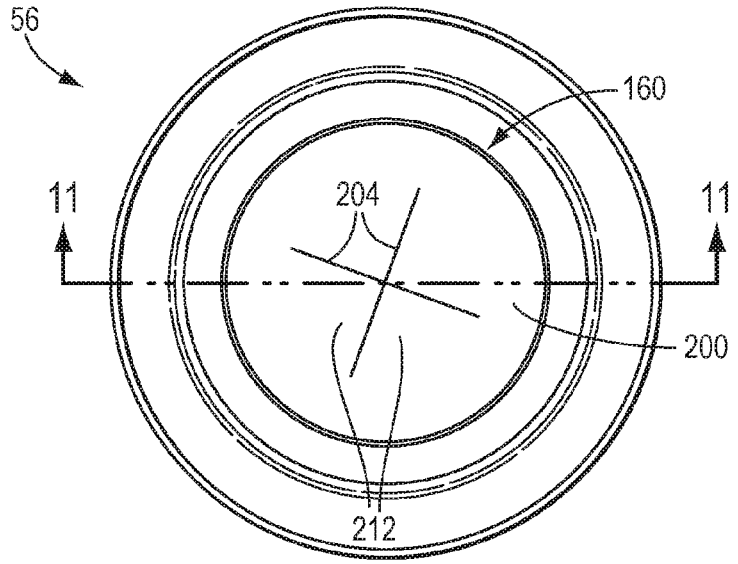
FIG. 9 is a top plan view of the valve shown in FIG. 2.
Figure 10:
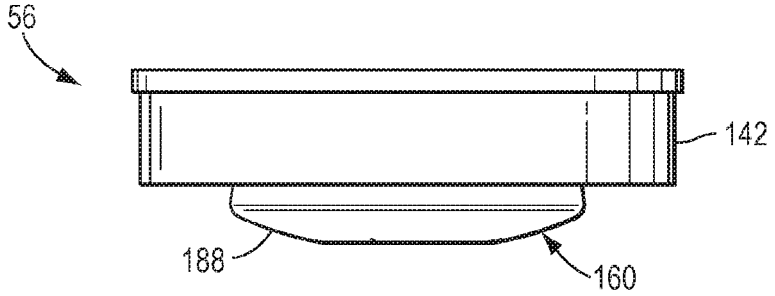
FIG. 10 is a side elevation view of the valve shown in FIG. 9.
Figure 11:
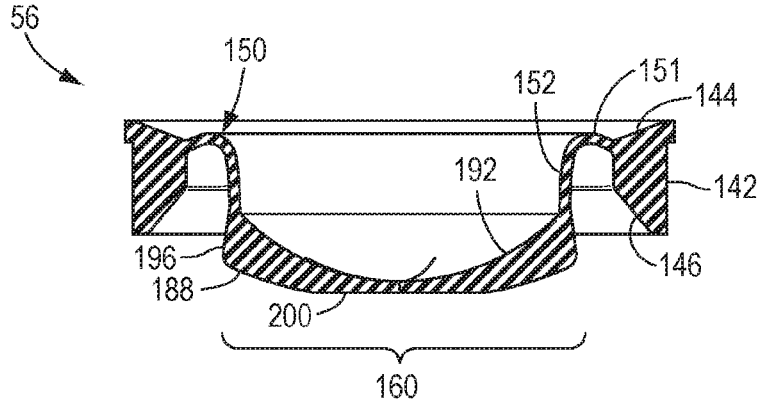
FIG. 11 is a cross-sectional view of the valve taken generally along the plane 11-11 in FIG. 9.
Figure 12:
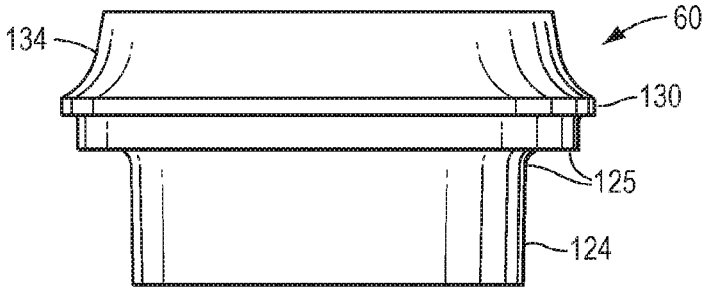
FIG. 12 is a side elevation view of a the retainer ring shown in FIG. 2.
Figure 13:
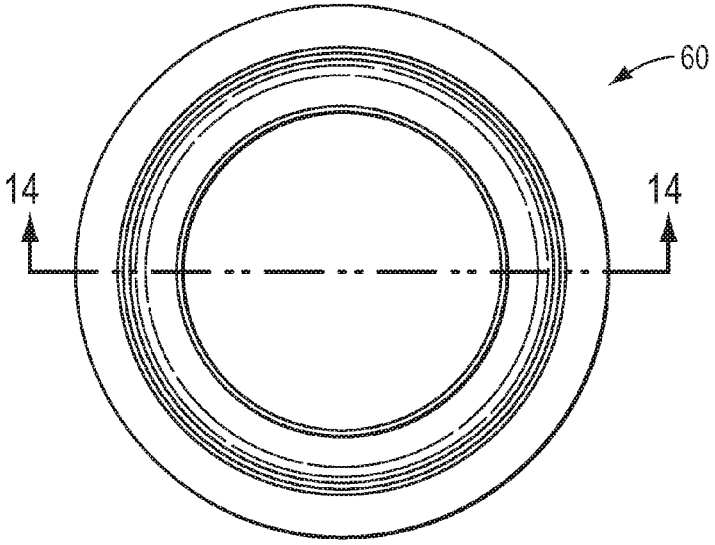
FIG. 13 is a top plan view of the retainer ring shown in FIG. 12.

With reference to FIG. 6A, the valve 56 is configured for being located within the closure body 54 between the inlet and outlet flow passages 74 and 78, respectively (FIGS. 2, 6, and 6A). The valve 56 is a flexible, resilient, pressure-openable, self-closing, slit-type valve (as best shown in FIGS. 9-11). Similar type valves are generally disclosed in the U.S. Pat. Nos. 5,377,877 and 5,839,614. The descriptions of those patents are incorporated herein by reference thereto to the extent pertinent and to the extent not inconsistent herewith.

The valve 56 is suitable for use with fluent substances, such as liquids, gases, or particulates such as powders, and other substances including, inter alia, fluids, mixtures, solutions, and suspensions. The valve 56 disclosed herein is especially suited for use with a low-viscosity fluent substance such as a hair oil.

The valve 56 is preferably molded as a unitary structure (i.e., one-piece structure) from material which is flexible, pliable, elastic, and resilient. This can include elastomers, such as a synthetic, thermosetting polymer, including silicone rubber, such as the silicone rubber sold by Dow Corning Corporation in the United States if America under the trade designation D.C. 99-595 and RBL-9595-40. Both of these materials have a hardness rating for 40 Shore A. Another suitable silicone rubber material is sold in the United States of America under the designation Wacker 3003-40 by Wacker Silicone Company. The valve 56 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts. For example, a particular non-silicone material that may be employed is ethylene propylene diene monomer rubber ("EPDM"), such as sold in the United States of America under the designation Grade Z1118 by Gold Key Processing, Inc. having an office at 14910 Madison Road, Middlefield, Ohio 44062, United States of America. Another non-silicone material that may be employed is nitrile rubber, such as sold in the United States of America under the designation Grade GK0445081-2 by Graphic Arts Rubber, having an office at 101 Ascot Parkway, Cuyahoga Falls, Ohio 44223, United States of America. It is desirable in many applications that the material be substantially inert so as to avoid reaction with, and/or adulteration of, the fluent substance in contact with the valve 56.

The valve 56 has an initially closed, unactuated, substantially unstressed, rest position or configuration (as best seen in FIGS. 9, 10, and 11). The valve 56 can be forced to an "open" position or configuration (FIG. 6B) when a sufficiently high pressure differential acts across the valve 56 as described hereinafter.

With reference to FIGS. 6A and 11, the valve 56 has a peripheral mounting portion or flange portion 142 having a generally dove-tail configuration when viewed in vertical cross-section as shown in FIGS. 6A and 11. The flange portion 142 may have any suitable configuration for being mounted to, attached to, connected with, or for otherwise being retained between the closure body 54 and the retainer ring 60. Preferably, the flange portion 142 is somewhat resiliently compressed so as to accommodate the creation of a secure, leak-resistant seal when the valve flange portion 142 is compressively engaged between the closure body 54 and the retainer ring 60. To that end, the valve flange portion 142 includes a first frustoconical surface 144 for engaging the mating frustoconical, valve-seating surface 90 on the closure body 54, and the valve flange portion 142 also includes a second frustoconical surface 146 for engaging the valve-seating surface 136 on the retainer ring 60.

With appropriate modification of the closure body 54 and the retainer ring 60, other shapes could be used for the valve flange portion 142. Some other shapes of flange cross sections that could be employed on the valve 56 are illustrated in the U.S. Pat. No. 5,409,144. In some applications, it may be desirable to configure the flange portion 142 for attachment to one or both of the closure body 54 and the retainer ring 60 by means of adhesive, bi-injection molding, heat bonding, plastic deformation of a portion of the closure body 54 around the valve flange portion 142, or other suitable attachment means.

Now referring to FIG. 11, the valve 56 further has a generally annular, intermediate connecting portion or sleeve 150 which connects the flange portion 142 to a central valve head portion 160. The intermediate connecting portion 150 is preferably substantially thinner than the valve head portion 160 and may be characterized as having a generally inverted J-shaped cross-sectional configuration as viewed along the longitudinal plane of the cross-section illustrated in FIG. 11, wherein the intermediate portion 150 has a first leg 151 that extends generally laterally in a first direction, and wherein the intermediate portion 150 has a second leg 152 that extends generally axially in a second direction. The function of intermediate connecting portion 150 will be discussed in detail hereinafter.

The valve head portion 160 is flexible and resilient. As can be seen in FIG. 9, the valve head portion 160 has a generally circular configuration. Referring to FIG. 11, the valve head portion 160 may be characterized as having an inlet side 188 facing in the axially inward direction toward the container interior (not shown in FIG. 11, hut visible in FIG. 6), and may be further characterized as having an opposing, outlet side 192 facing in the axially outward direction away from the container interior (not shown in FIG. 11, but visible in FIG. 6). When the valve 56 is closed, the head 160 has a concave configuration when viewed from the outlet side 192, and the head 160 has a generally convex configuration when viewed from the inlet side 188.

With reference to FIG. 11, the outer perimeter of the valve head portion 160 is preferably defined by a slightly flared, peripheral, marginal surface 196 which extends annularly around the valve head portion 160 and ultimately terminates at the substantially thinner, intermediate portion 150. The valve head portion 160 further has a central portion 200 that has a planar, circular configuration when the valve head portion 160 is in the fully retracted, closed, position.

When the valve head portion 160 is viewed in cross-section, as illustrated in FIG. 11, the valve head portion 160 is somewhat thicker at a laterally or radially outer region of the valve head portion 160, and is thinner at a laterally or radially inward, center region. This configuration assists in providing a desirable opening action and closing action.

Figure 6B:
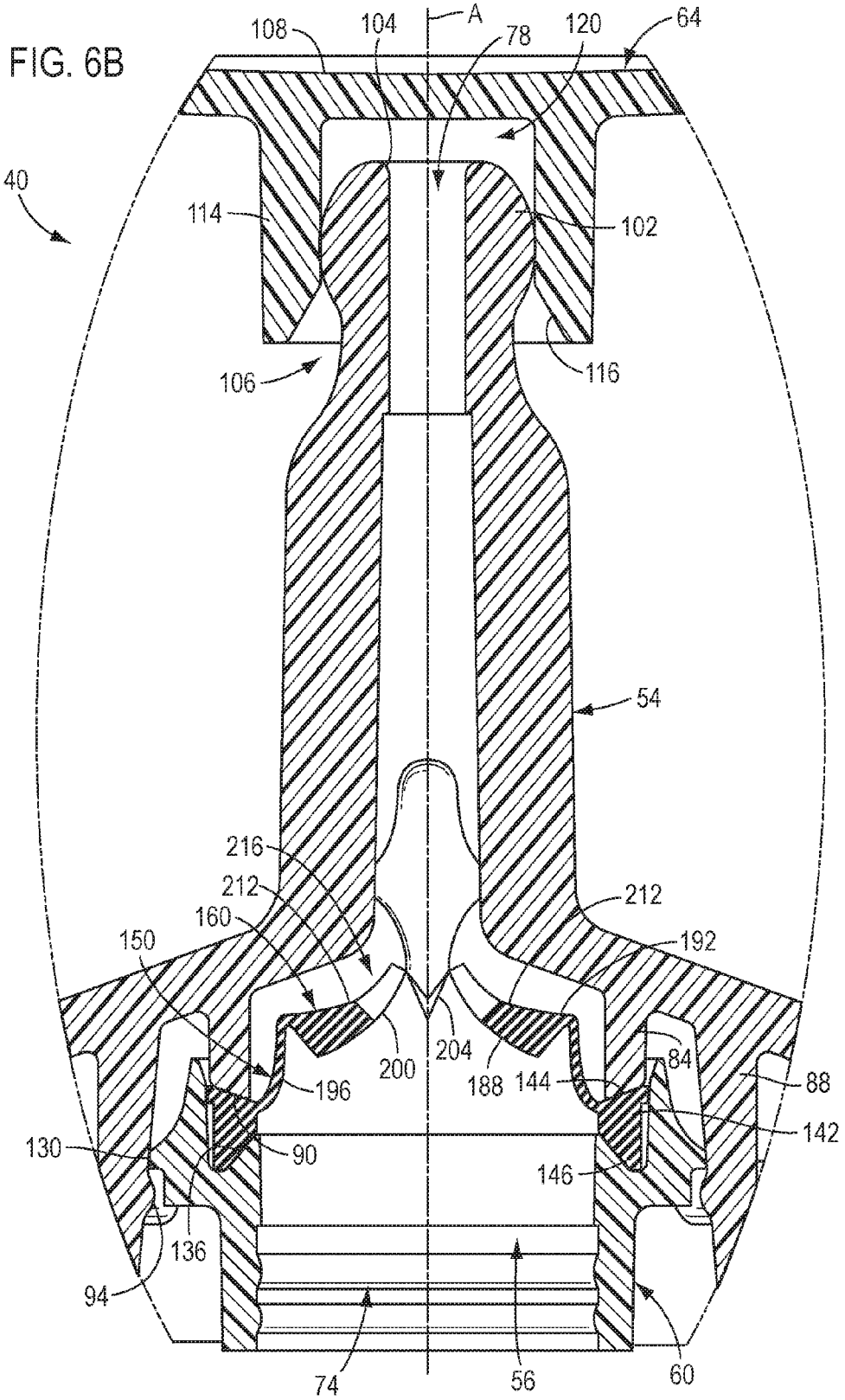
FIG. 6B is a similar view to FIG. 6A, however in FIG. 6B the valve is shown in an open configuration.

The flexible valve 56 changes configuration between (1) a retracted, closed, rest position (as shown closed in FIGS. 6A and 9-11), and (2) an extended, active, open position (FIG. 6B). When the valve 56 opens, the fluent substance can be dispensed (i.e., discharged) through the valve 56 in a discharge flow direction generally along the longitudinal axis A defined by the closure body 54.

With reference to FIG. 9, the valve head portion 160 has a normally closed orifice defined by a plurality of slits 204 extending laterally or radially from the center of the valve head portion 160. The illustrated preferred embodiment of the valve 56 has two slits 204 intersecting at substantially a right angle. A lesser or greater number of slits 204 could be used depending on the flow characteristics required by the application. The slits 204 extend longitudinally through the valve head portion 160 from the inlet side 188 to the outlet side 192. In the illustrated embodiment of the valve 56, the slits 204 are of equal length, although the slits could be of unequal lengths (not illustrated).

The slits 204 define four, generally triangular-shaped, equally sized flaps or petals 212 (FIG. 9) in the valve head portion 160. The petals 212 may be also characterized as "openable regions" or "openable portions" of the valve head portion 160. Each petal 212 has a pair of transverse faces defined by the slits 204, and each transverse face seals against a confronting transverse face of an adjacent petal 212 when the valve 56 is closed. Forms of such a type of slits in a valve are disclosed in the U.S. Pat. No. 5,377,877. The description of that patent is incorporated herein by reference thereto to the extent pertinent and to the extent not inconsistent herewith.

The valve 56 can be molded with the slits 204. Alternatively, the valve slits 204 can be subsequently stamped or cut into the valve head portion 160 by suitable conventional techniques. In operation, the petals 212 can be forced to open outwardly (FIG. 6B) from the intersection point of the slits 204 when a sufficient force is applied to the inlet side 188 of the valve head portion 160 (as by subjecting the valve 56 to a pressure differential across the valve head portion 160, such that the pressure on the inlet surface 188 of the valve 56 is greater than the pressure on the outlet surface 192 of the valve by a sufficient amount).

The valve head portion 160, intermediate portion 150, and slits 204 are preferably configured for use in conjunction with a particular container, and a specific type of fluent substance, so as to achieve the flow characteristics desired. For example, the viscosity, density, and mixture properties of the fluent substance are factors to be considered. The rigidity and durometer of the valve material, and size and thickness of portions of both the valve head portion 160 and the intermediate portion 150 are additional factors to be considered.

With reference to FIGS. 6A and 6B, the valve 56 and the closure body 54 together define an outlet chamber 216 that is located between the outlet surface 192 of the valve 56 and the outlet flow passage 78 of the closure body 54. The outlet chamber 216 accommodates axially outward movement of the valve 56 in the open position (FIG. 6B), and preferably has a diameter (in the plane normal to the longitudinal axis A) that is substantially greater than the diameter of the outlet flow passage 78, the function of which will be discussed in detail hereinafter.

The valve 56 in the illustrated preferred embodiment of the dispensing closure 40 is intended, in dispensing applications, to be opened axially outwardly when the pressure at the inlet flow passage 74 is greater than a pressure at the outlet flow passage 78 by a predetermined amount. Moreover, in some applications the valve 56 could also open inwardly to allow in-venting when the valve outlet side 192 back pressure is greater than the pressure at the valve inlet side 188 by a predetermined amount. Such a back pressure might result from the creation of a reduced pressure ("vacuum") inside of the container 44 as can occur with a flexible and resilient container after the user has first squeezed the container 44 during dispensing but then has stopped squeezing the container 44, which returns to its normal configuration, causing a temporary drop in the internal pressure of the container 44 until sufficient in-venting of ambient atmosphere has occurred to equalize the internal and external pressures. In the following discussion, the operation of the valve 56 will be described with reference to a dispensing application wherein there is a pressure at the valve inlet side 188 that is sufficient to open the valve 56 axially outwardly into a lower outlet pressure environment.

The opening of the valve 56 may be characterized as occurring in response to a predetermined minimum opening pressure (relative to the external ambient atmosphere). The valve 56 is typically designed to have a predetermined minimum opening pressure which causes the valve petals 212 to open to a desired cross-sectional flow area which may be characterized as fully open for the particular design pressure differential across the valve 56. The selection of a desired predetermined minimum opening pressure is determined in accordance with, inter alia, the flow criteria desired for a particular fluid substance, and/or the maximum static head (if any), or other upstream pressure, that is exerted on the inlet side 188 of the valve 56 below which the valve 56 is designed to remain closed.

The dispensing closure 40 functions as next described herein, with reference to FIGS. 6 and 6A. Typically, a user will remove the lid 64 (if provided) by pulling the lid 64 away from the closure body 54 to remove the annular wall 114 of the lid 64 from the closure body tip 102. The user will then grasp the flexible, resilient container 44 so as to collapse or otherwise reduce the volume of the container 44 to pressurize the fluent substance contained therein. In some situations, the user may also invert the container 44. In any event, the pressurized fluent substance initially enters the inlet flow passage 74 of the closure body 54 and flows through the hollow retainer ring 60. The fluent substance then confronts the inlet surface 188 of the valve head portion 160.

Still referring to FIG. 6A, until the valve 56 is subjected to a sufficiently high inlet pressure, the valve 56 remains in an initial, normally closed configuration, wherein the valve 56 remains substantially in its original, as-molded shape without deformation (except perhaps at the flange 142 if the flange 142 is sufficiently compressively engaged by the valve-seating surfaces 90 and 136). When the valve 56 is in the normally closed configuration, the valve intermediate portion 150 is substantially unstressed, and the valve orifice slits 204 are completely closed. The normally closed configuration of the valve 56 prevents, or at least minimizes, the potential for accidental dispensing or spilling of the fluent substance if the package lid 64 has been removed and the package is accidentally inverted and/or perhaps accidentally impacted to create a slight increase in internal pressure.

Referring now to FIG. 6B, when a sufficiently high pressure differential is established across the valve head portion 160, such as when increased pressure is established on the valve inlet side 188 by pressurization of the fluent substance, the valve intermediate portion 150 and valve head portion 160 are forced axially outward into the chamber 216. The valve petals 212 open axially outwardly to create an open orifice at a predetermined pressure differential, and thereby dispense the fluid substance through the valve head portion 160. The fluent substance then enters the chamber 216 and exits through the narrower outlet flow passage 78. The fluent substance subsequently travels through the narrow, outlet flow passage 78 and is dispensed from the tip 102 onto a target region (e.g., the skin or scalp of a user) allowing the user to dispense the fluent substance with greater precision than with prior art closures. If the closure body 54 and/or elongate outlet portion 70 is formed from a generally transparent material, then the fluent substance is visible to the user to help with controlling the dispensing of the fluent substance through the outlet flow passage 78.

The inventors have found that the sloping lip 104 of the substantially spherical tip 102 of the closure body 54 may prevent, or at least minimize, undesirable adherence of the fluent substance to the tip 102 after the aforementioned dispensing process and further may prevent undesirable accumulation of fluent substance within the space between the annular wall 114 of the lid 64 and the tip 102.

When the user ceases to pressurize the container 44, the axially outward flow of the fluent substance is stopped as the valve petals 212 snap closed owing to a resiliency of the valve 56, and this provides a quick and strong "cut-off" of the flow out of the valve 56. Further, a back pressure differential is preferably established across the valve head portion 160, such that the pressure at the valve outlet side 192 is greater than the pressure at the valve inlet side 188 as the resilient container 44 returns to its unstressed configuration and creates a temporary lower pressure within the container 44. As the intermediate connecting portion 150 and the valve head portion 160 snap closed to their initial rest positions, the petals 212 can continue to open inwardly (i.e., with reference to FIG. 6A, the valve petals would bend downwardly to open below the closed position shown in FIG. 6A). This allows some or all of the higher pressure fluent substance within the outlet flow passage 78 and/or the chamber 216 to flow into the lower pressure inlet flow passage 74. Thus, the shape and location of the valve 56 serve to prevent, or at least minimize, residual fluent substance from remaining in the outlet flow passage 78, the chamber 216, and/or on the outlet surface 192 of the valve head portion 160, and that helps maintain the overall cleanliness of the package.

Prevention of residual fluent substance remaining within the outlet flow passage 78 after dispensing can reduce the accumulation of fluent material within the lid 64 and reduce accidental dispensing or spills for highly fluent, low viscosity substances if the package is accidentally pressurized or inverted.

Referring to FIG. 6A, the inventors have found that providing an elongate outlet portion 70 having a relatively great axial length (along axis A) increases the time required for the fluent substance to travel to the tip 102 and dampens or muffles the overall dispensing action to give the user more control over the dispensing process. In one presently preferred embodiment, the elongate outlet portion 70 is preferably at least two times greater than an axial length of the chamber 216. Preferably, the chamber 216 has an axial length of about 6.0 mm and the elongate outlet portion has an axial length of about 17 mm. Preferably, the elongate outlet portion 70 of the closure body 54 has an axial length that is at least five times greater than the diameter of said outlet flow passage. The inventors have further found that the combination of the elongate outlet portion 70 and the valve 56 greatly increases the ability of the user to dispense product as a controlled drop or a stream.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A dispensing closure (40) for a container (44) having an opening between an exterior of the container (44) and an interior of the container (44) where a fluent substance may be stored, said dispensing closure (40) comprising:

A. a closure body (54) that 1) has an inlet portion (68) that can be located at the container opening and that defines an inlet flow passage (74) for communicating with the container interior, and 2) has an elongate outlet portion (70) defining an outlet flow passage (78) to accommodate the flow of a substance from said inlet flow passage (74) through said dispensing closure (40); and B. a valve (56) having a flexible, resilient valve head portion (160) that has 1) at least one self-sealing slit (204) through said valve head portion (160), and 2) confronting, openable portions (212) along said at least one self-sealing slit (204) in an initially closed configuration, said openable portions (212) being movable from said closed configuration to an open configuration when said valve head portion (160) is subjected to a pressure differential acting across said valve head portion (160);

wherein said valve (56) is located across said inlet flow passage (74) and is spaced axially inwardly from said outlet flow passage (78) such that said valve (56) and said closure body (54) together define a chamber (216) inwardly of, and communicating with, said outlet flow passage (78) to accommodate said valve head portion openable portions (212) in said open configuration, wherein said elongate outlet portion (70) of said closure body (54) terminates in a tip (102) having the form of a truncated sphere, wherein said truncated sphere has an outer surface connected to said outlet flow passage (78) by an axially and laterally inwardly curving surface (104).

* * * * *